US005421579A

United States Patent [19]

Uebele, Jr.

[11] Patent Number: 5,421,579

[45] Date of Patent: Jun. 6, 1995

[54] TRAINING APPARATUS FOR A GOLF SWING

[76] Inventor: Herman Uebele, Jr., 2016 Beechwood Ct., LaPorte, Ind. 46350

[21] Appl. No.: 261,173

[22] Filed: Jun. 13, 1994

[51] Int. Cl.[6] ..... A63B 69/36

[52] U.S. Cl. ..... 273/191 R

[58] Field of Search ..... 273/191 R, 191 A, 191 B, 273/192, 186.1

[56] References Cited

U.S. PATENT DOCUMENTS

| | | | |
|---|---|---|---|
| 1,005,948 | 10/1911 | English . | |
| 1,567,530 | 12/1925 | MacNaughton et al. | 273/191 A |
| 1,634,102 | 6/1927 | Hansen | 273/191 A |
| 2,653,025 | 9/1953 | Zega | 273/191 |
| 2,807,472 | 9/1957 | Hatfield | 273/191 |
| 3,444,729 | 5/1969 | Shobert | 73/100 |
| 3,460,837 | 8/1969 | Cassa, Jr. | 273/186.1 |
| 3,703,294 | 11/1972 | Fitch | 273/191 B |
| 4,280,701 | 7/1981 | Beckish | 273/191 |
| 5,005,836 | 4/1991 | Nelson | 273/191 R |
| 5,050,874 | 9/1991 | Fitch | 272/136 |
| 5,072,942 | 12/1991 | Hurley | 273/191 A |

FOREIGN PATENT DOCUMENTS

| | | | |
|---|---|---|---|
| 174140 | 1/1922 | United Kingdom . | |
| 1174773 | 12/1969 | United Kingdom | 273/191 A |

*Primary Examiner*—George J. Marlo

*Attorney, Agent, or Firm*—R. Tracy Crump

[57] ABSTRACT

An apparatus used by a golfer for developing a forward golf swing. The apparatus guides the club within a predetermined swing plane and controls the attitude of the club within the swing plane only through the initial portion of the forward swing into the "attack zone." The apparatus includes a swing guide and a club attachment mounted to the club shaft adjacent the grip. The swing guide includes an arcuate track mounted to a post and positioned behind the golfer. The track guides the club within a predetermined swing plane through an initial portion of said forward swing. The lower end of the track is positioned at the natural release point of the golfer's swing, which is approximately at the start of the golfer's "attack zone." The club attachment includes a carriage, a mounting collar, and a connecting rod. The carriage is movable along the length of the track. The club attachment maintains the club at a fixed predetermined attitude within said swing plane while the carriage is in engagement with the track.

20 Claims, 5 Drawing Sheets

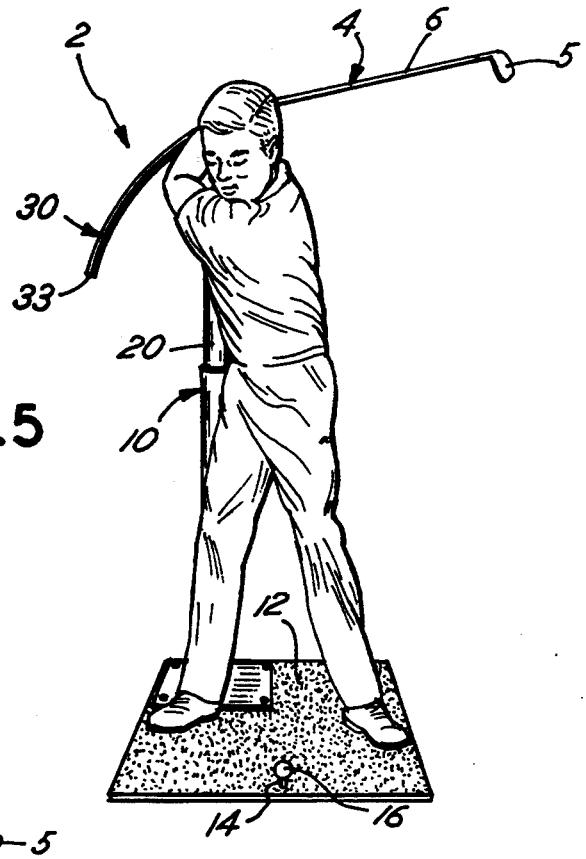
Fig. 5
Fig. 6
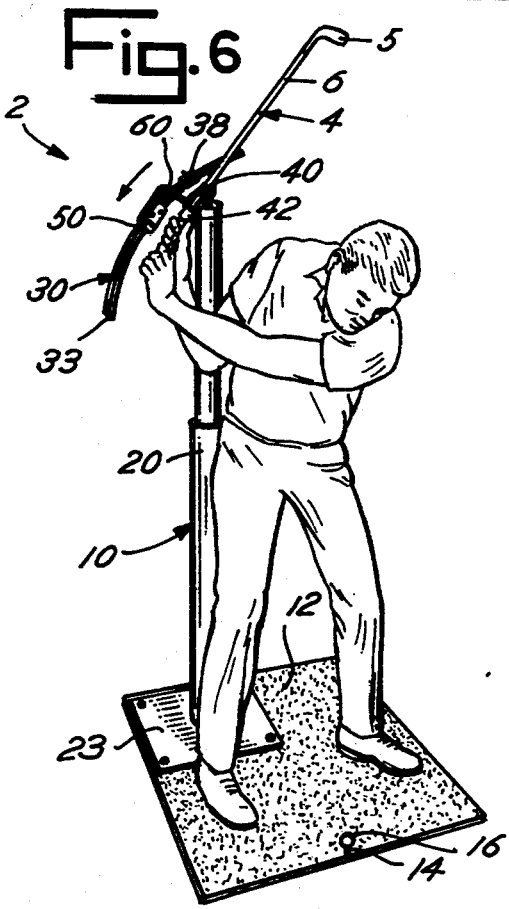
Fig. 7
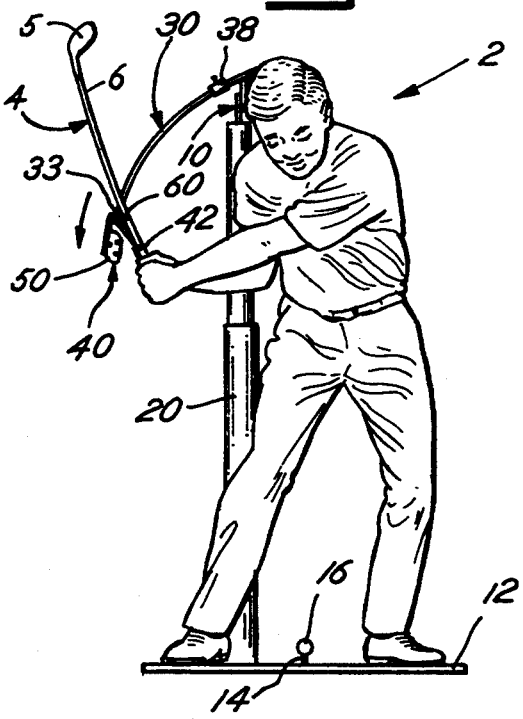

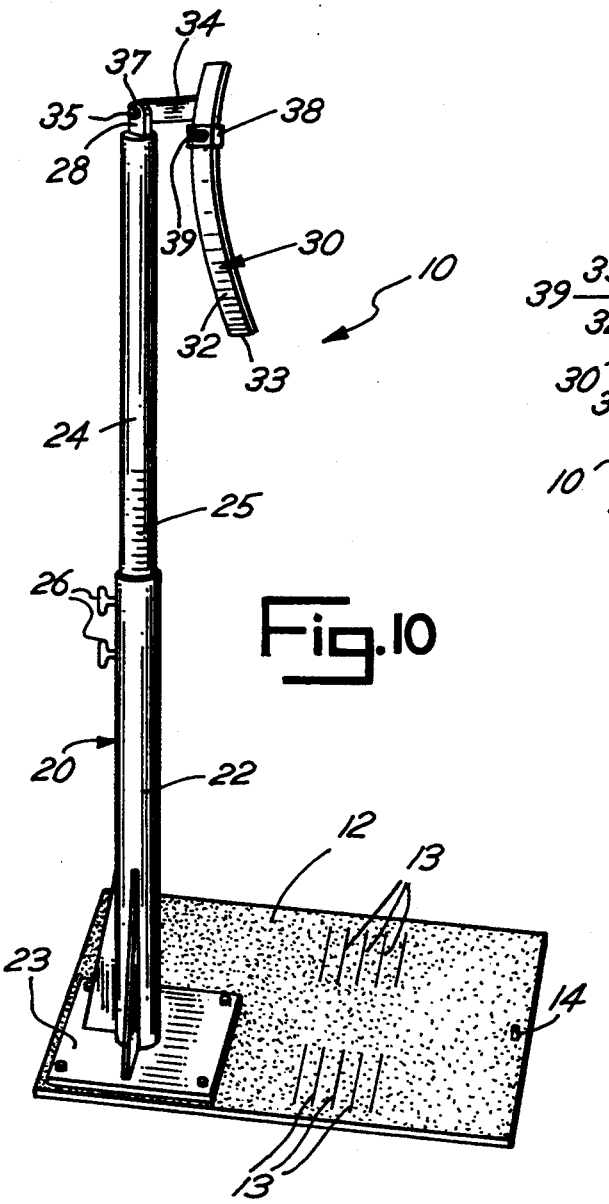
Fig.10
Fig.11
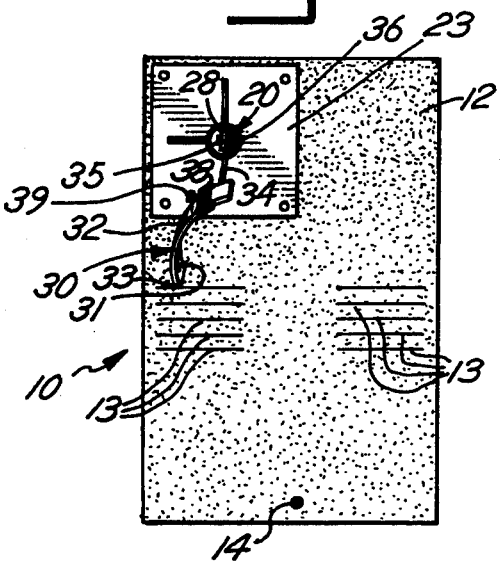
Fig.12
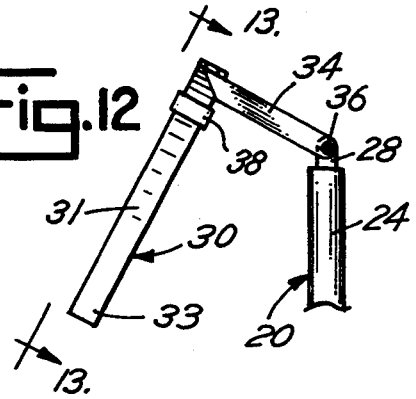
Fig.13
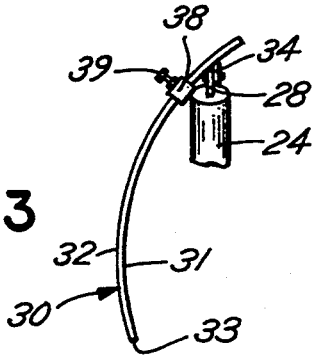

Fig. 14
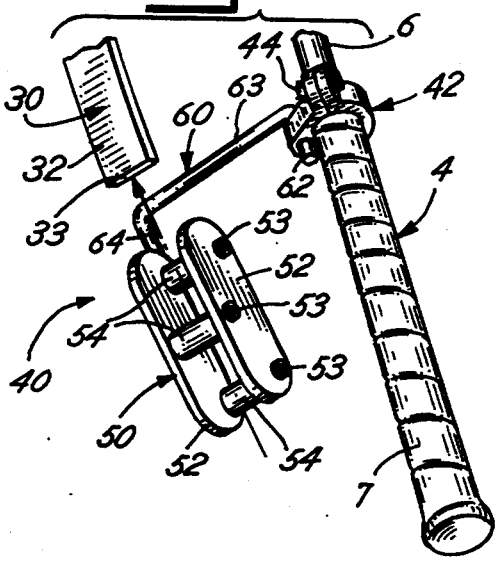
Fig. 15
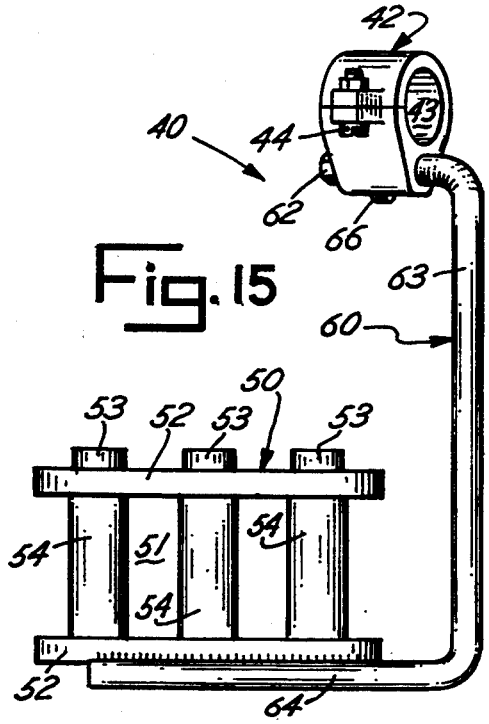
Fig. 17
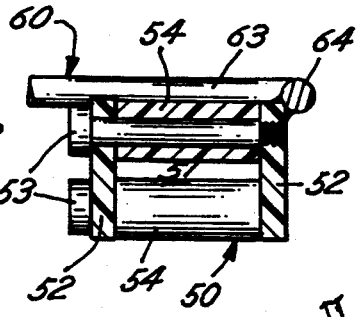
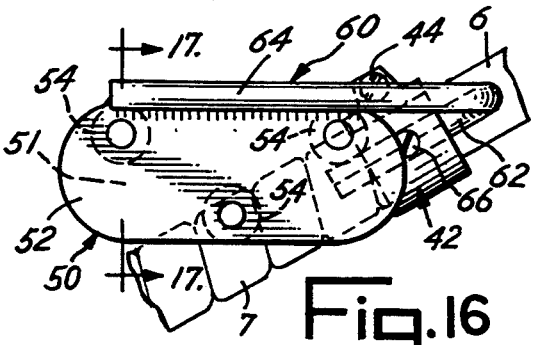
Fig. 16
Fig. 18
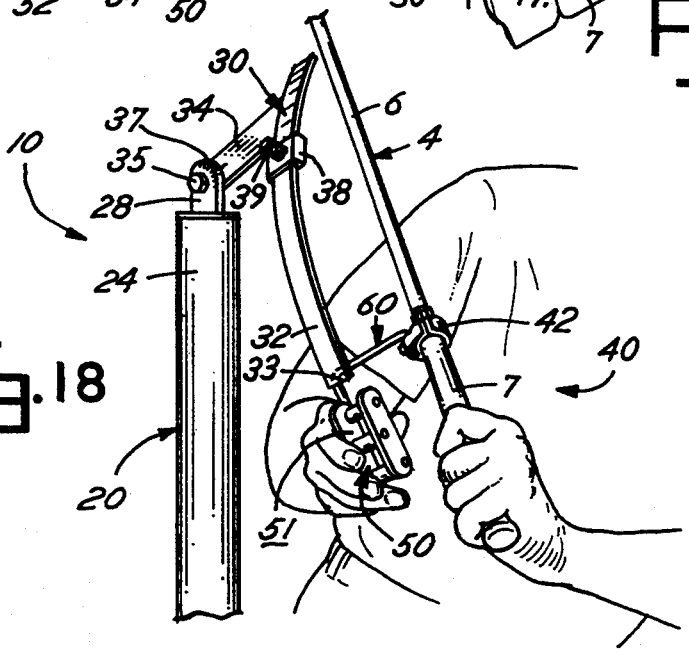

TRAINING APPARATUS FOR A GOLF SWING

This invention relates to a training apparatus for developing the physical technique of swinging a golf club.

BACKGROUND OF THE INVENTION

Properly swinging the golf club is the most critical aspect of the game of golf. Typically, most technique problems in a golf swing occur between the starting point of the forward swing and the start of the "attack zone." The "attack zone" is the portion of the swing where the golfer uncoils his wrists and upper body to contact the ball and where power is generated and accuracy is gained or lost. While only a small part of the entire golf swing, proper execution into the "attack zone" is essential for developing distance and accuracy.

The biomechanics of a proper golf swing are often unnatural to the beginning and novice golfer. The natural tendency of a golfer is to break his wrists prematurely and to introduce a horizontal shoulder rotation at the starting point of the forward swing. These problems are generally due to the natural tendency to allow the dominant hand to push the club into the swing.

A variety of commercial devices have been developed for improving swing technique. Most of these devices comprise elaborate mechanical frames which guide the club head along a set swing plane. Typically, these devices neglect the positioning and attitude of the golfer's body during the execution of the swing. In addition, conventional swing training devices are unable to consistently position the golfer at the starting point of the forward swing or facilitate the proper attitude and movement of the golfer's wrists and upper body. Consequently, these devices are ineffective in developing the proper biomechanics of a golf swing.

SUMMARY OF THE INVENTION

The swing training apparatus or swing trainer of this invention enables the golfer to develop the proper technique for swinging a club. Instead of simply manipulating the path of the club head as other devices commonly do, the swing trainer of this invention guides the club within a predetermined swing plane and controls the attitude of the club within the swing plane through the initial portion of the forward swing into the critical "attack zone." By controlling the attitude of the club within the swing plane, the swing trainer also controls the physical movement of the golfer's wrists and upper body. Since the swing trainer controls the physical movement of the golfer, it allows the golfer to develop the neuro-muscular recognition and coordination of a proper golf swing. The swing trainer guides the golfer only through the initial portion of the forward swing into the "attack zone," thus eliminating the elaborate framework of other aids and allowing unrestricted movement through the remainder of the swing. In addition, the swing trainer allows the golfer to consistently begin the forward swing from a set starting position. Consequently, the swing trainer eliminates the need to develop an elaborate back swing.

The swing trainer of this invention includes a swing guide and a club attachment secured to the club shaft adjacent the grip. The swing guide includes an arcuate track mounted to a post and positioned behind the golfer outside of the golfer's peripheral vision. Consequently, the swing trainer provides a more realistic environment and reduces visual distractions. Preferably, the post is mounted to a stationary platform. The track guides the club within a predetermined swing plane through the initial portion of the forward swing. The length of the track is relatively small with respect to the entire path of a golf swing. The lower end of the track is positioned at the natural release point of the golfer's swing, which is approximately at the start of the golfer's "attack zone." The club attachment is preferably connected to a weighted practice club. The club attachment includes a carriage, a mounting collar, and a connecting rod. The carriage is movable along the length of the track. The club attachment maintains the club at a fixed predetermined attitude within said swing plane while the carriage is in engagement with the track.

In use, the golfer assumes a conventional golf stance with his back to the swing guide. The track is positioned behind the golfer outside the golfer's peripheral vision and off the golfer's right shoulder (for a right handed golfer). Holding the club with one hand, the golfer simply raises the club and using the other hand guides the carriage onto the lower end of the track. The carriage is slid up the track to the proper starting point at the apex of the back swing. At the starting point, the golfer adjusts his grip on the club and assumes a proper stance for beginning the forward swing. To begin the forward swing, the golfer first shifts weight from the right to the left side, which initiates the downward movement of the carriage along the track. As the carriage moves downward along the track, the club attachment forces the club to remain at the proper attitude within the correct swing plane. While the club attachment is engaged with the track, the golfer is forced by his grip of the club to keep his wrists "cocked" and to swing the club "on plane." As the carriage clears the lower end of the track, the golfer's wrists and upper body are freed. The momentum of the swing and the golfer's natural tendency to break his wrists takes over at this point to generate maximum club head speed. Consequently, the movement of the club attachment along the track guides and controls the golfer through the critical initial portion of the golf swing into the "attack zone."

Accordingly, an advantage of this invention is to provide for a unique and novel golf swing training apparatus.

Another advantage of this invention is to provide for a golf swing training apparatus that guides the club through the initial portion of the forward swing into the "attack zone."

Another advantage of this invention is to provide for a golf swing training apparatus that ensures that the golfer assumes and maintains the proper "on plane" upper body position and wrist attitude while executing a golf swing.

Another advantage of this invention is to provide a golf swing training apparatus that controls the physical movement of the golfer through the initial portion of the swing.

Another advantage of this invention is to provide a golf swing training apparatus that controls the golf swing from behind the golfer without obstructing the golfer's direct or peripheral vision of the ball.

Other advantages will become apparent upon a reading of the following description.

BRIEF DESCRIPTION OF THE DRAWINGS

A preferred embodiment of the invention has been depicted for illustrative purposes only wherein:

FIG. 5 is a front view of a golfer using the swing training apparatus of this invention shown positioned at the top of a back swing;

FIG. 6 is perspective view of a golfer using the swing training apparatus showing the golfer initiating the forward swing;

FIG. 7 is a golfer using the swing training apparatus at the start of the "attack zone" or release point of the forward swing where the carriage clears the lower end of the track;

FIG. 10 is a perspective view of the swing guide of the swing training apparatus;

FIG. 11 is a top view of the swing guide;

FIG. 12 is a partial right side view of the swing guide showing the swing plane of the track;

FIG. 13 is a partial front view of the swing plane guide taken along line 13—13 of FIG. 12;

FIG. 14 is a perspective view of the club attachment of the swing training apparatus;

FIG. 15 is a top view of the club attachment;

FIG. 16 is a right side view of the club attachment;

FIG. 17 is a sectional view of the carriage taken along line 17—17 of FIG. 16; and FIG. 18 is a perspective view showing a golfer sliding the club guide onto the track.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 1:
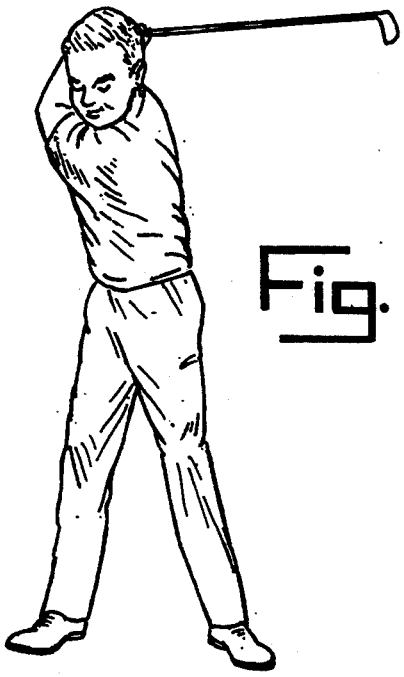
FIG. 1 is a front perspective of a golfer at the top of a back swing.
Figure 2:
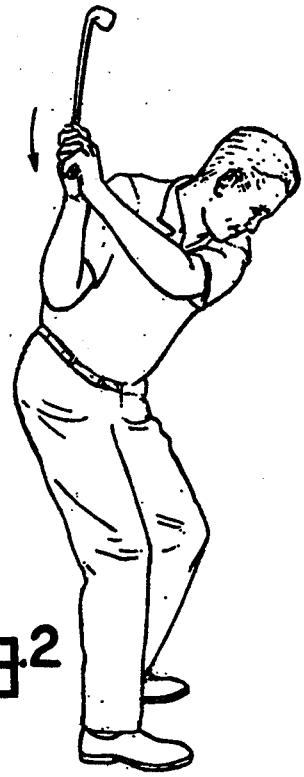
FIG. 2 is a side view of a golfer at the start of the forward swing.
Figure 3:
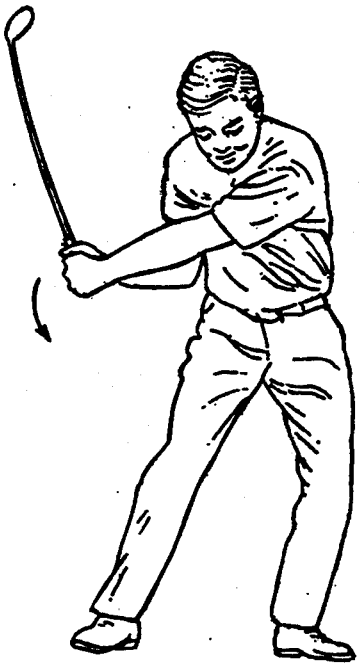
FIG. 3 is a front view of a golfer at the start of the "attack zone" or release point of the forward swing.
Figure 4:
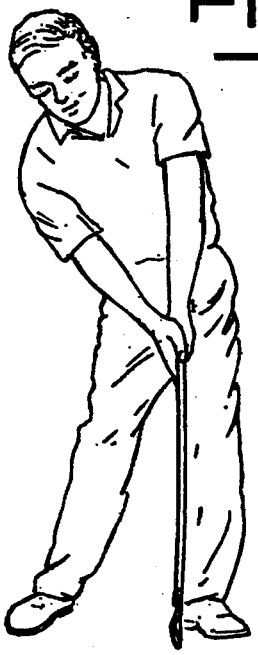
FIG. 4 is a front view of a golfer at the contact point of a golf swing.

FIGS. 1–4 show a golfer illustrating the ideal technique and body positioning for swinging a golf club. FIGS. 1–4 are included to assist in understanding the operation of this invention and to illustrate the desired biomechanics that the invention helps to facilitate. FIG. 1 shows the golfer at the top of the back swing. At the top of the back swing the golfer's shoulders are fully rotated and in line with the ball. FIG. 2 shows the golfer starting the forward swing towards the ball. As the golfer moves from the top of the back swing to begin the forward swing, the golfer's weight is shifted from his right side to his left side. Ideally, the forward swing is initially dominated by the golfer's left side. As shown in FIG. 2, the golfer's upper body is "loaded." His shoulders are rotated, his wrists are cocked, his left arm is substantially straight and his right elbow is tucked close to his right side. The golfer's upper body remains "loaded" as he enters the "attack zone." FIG. 3 shows the golfer at the release point of the forward swing, which is the start of the "attack zone." At the release point, the golfer begins to break his wrists and allows his shoulders to rotate through the ball. FIG. 4 shows the golfer at the contact point of the swing. At the contact point the wrists are fully extended towards the ball and the shoulders are substantially square to the ball.

FIGS. 5–18 show the swing training apparatus or swing trainer 2 of this invention. Swing trainer 2 includes a swing guide 10 and a club attachment 40 connected to a golf club 4. Swing trainer 2 is intended to assist a golfer in developing the physical coordination and proper technique for swinging a golf club. For simplicity, the preferred embodiment of the invention is described and explained for use by a right handed golfer, but the teaching of this invention can be easily applied for use by a left handed golfer. Although golf balls can actually be hit while using the swing trainer, the invention is intended to be used as a training device for developing neuro-muscular coordination and proper technique for swinging the golf club without actually hitting a ball.

FIGS. 10–13 show the swing guide 10. Swing guide 10 includes an arcuate segment or partial track 30 pivotally mounted to a telescoping post 20. Preferably, post 20 is mounted to a stationary platform 12; however, the post can be permanently secured to level ground or any other horizontal surface. Platform 12 includes a rubber tee 14. A golf ball or practice ball 16 can be placed on tee 14 to provide a target for the golfer. Platform 12 has markings 13 to indicate the proper positioning of the golfer's feet with respected to tee 14 and swing guide 10. Post 20 includes a tubular lower section 22 and an extensible upper section 24. A bracket 28 extends vertically form the upper end of upper section 24. Lower section 22 is mounted to platform 12 by a mounting plate 23. Upper section 24 is extensibly secured within lower section 22 by fasteners 26 which allow the height of post 20 to be adjusted to accommodate golfers of various heights. In addition, upper section 24 can be rotated within lower section 22 to adjust the positioning of track 30. Post 20 has markings 25 for conveniently determining the proper height adjustment and placement of the post for an individual golfer.

Preferably, track 30 is a curved band of steel or iron having a flat concave inner surface 31 and a flat convex outer surface 32. The upper end of track 30 is secured to an arm 34. Arm 34 is pivotally connected to post bracket 28 by a bolt 35 and nut 36. Track 30 is positioned with respect to post 20 so that the track lies in a plane that is substantially parallel to the proper swing plane of the golfer's club. The pivotal connection of arm 34 to post 20 allows track 30 to be positioned to accommodate different swing planes for each length of club. Arm 34 also has markings 37 for determining the proper position of track 30 for each club length. A stop collar 38 is used to establish a consistent starting point along the track for the forward swing. Stop collar 38 slides over track 30 and can be position at any point along its length. Stop collar 38 is secured to track 30 by bolt 39, which is turned into the collar and engages the track. As shown, the length of track 30 is relatively small with respect to the entire path of a golf swing. As shown in FIGS. 5–9, the lower or free end 33 of track 30 is positioned at the natural release point of the golfer's swing, which is approximately the start of the golfer's "attack zone." Track 30 constitutes a guide for the golfer only through a portion of the golf swing from the top of the back swing into the "attack zone."

Preferably, club attachment 40 is fitted to a weighted practice club, but any conventional golf club can be used. As shown, club 4 includes a solid shaft 6, a weighted club head 5, and a grip 7. Club attachment 40 includes a carriage 50, a mounting collar 42 and an U-shaped rod 60, which connects the carriage to the collar. Mounting collar 42 is secured to club shaft 6 directly below grip 7. As shown in FIG. 15, collar 42 has an opening 43 for receiving club shaft 6. Collar 42 is tightened around club shaft 6 by bolt 44. Carriage 50 is adapted for unilateral movement along the length of track 30. Carriage 50 includes three tubular rollers 54 connected between two side plates 52. Rollers 54 are triangularly spaced between side plates 52 to form a rectangular passage 51 therebetween for receiving track 30. Rollers 54 allow for frictionless movement of carriage 50 along the length of track 30. A bolt 53 extends through each roller to connect rollers 54 between the side plates. When carriage 50 is engaged with track 30, the track is interposed between rollers 54 and side plates 52 and can not be pulled from the track. While carriage 50 rides freely along the length of track 30, the engagement of track 30 between rollers 54 prevents carriage 50 from rotating about the track. As shown in FIG. 15, U-shaped connecting rod 60 has two end legs 62, 64 and cross leg 63. End legs 62, 64 are substantially parallel to each other when viewed from the top as in FIG. 15 and angled slightly when viewed from the side as in FIG. 16. End leg 62 extends through a bore in collar 42 and is secured by a bolt 66, which is turned into a threaded bore in collar 42 to engage the leg. End leg 64 is secured parallelly to carriage 50 along the length of one of the side plates 52.

When carriage 50 is engaged with track 30, club shaft 6 is substantially parallel to the plane of track 30, as best shown in FIG. 14. Consequently, as carriage 50 moves along the length of track 30, club 4 travels within a swing plane parallel to the plane of the track. As shown in FIG. 16, connecting rod 60 secures carriage 50 to collar 42 so that carriage passage 51 is angled to the longitudinal axis of club shaft 6. By connecting club shaft 6 to carriage 50 at that angle, club 4 is positioned at a fixed attitude within the swing plane when the carriage is engaged with track 30. The attitude of the club within the swing plane produces the "cocked" position of the golfer's wrists. As shown in FIG. 14, club shaft 6 is parallel to end leg 62. By loosening bolt 66, club shaft 6 can be shifted about end leg 62 to allow adjustments to the position of the face of the club head 5. By changing orientation of the club shaft 6 with respect to the connecting rod 60, the face of club head 5 can be "opened" for a "weak" wrist position (the back of the left wrist is bent with respect to the left forearm) or "closed" for a "strong" wrist position (back of the left wrist is flat with respect to the forearm) while the wrist remains cocked.

FIGS. 5–9 and 18 illustrate the use of swing trainer 10 by a golfer. First, the golfer stands on platform 12 with his back to swing guide 10 and addresses ball 16 in a proper stance. Marks 13 on platform 12 help to orient the golfer's stance. As shown in FIGS. 5–9, track 30 is positioned directly behind and off to the right of the golfer's right shoulder. When the golfer looks directly at ball 16, swing guide 10 is outside the golfer's peripheral vision and therefore not a visual distraction to the golfer's concentration. As shown in FIG. 18, the golfer grips club 4 with his left hand, raises the club and slides carriage 50 onto track 30 from its lower end 33. Track 30 passes through carriage passage 51 between rollers 54 and side plates 52 (FIG. 14). As shown in FIG. 5, club attachment 40 is moved up track 30 until carriage abuts stop collar 38 at the apex of the golfer's back swing. At this point, the golfer assumes a conventional two handed grip of club 4. Since track 30 is positioned behind the golfer, the golfer must rotate his shoulders to grasp the club with both hands. At this point, the golfer is ready to begin the forward swing.

Figure 8:
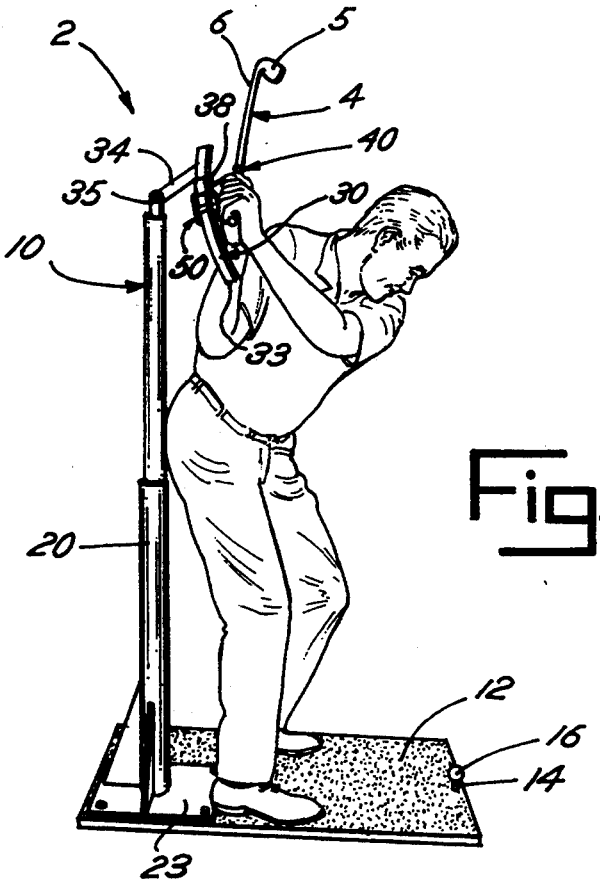
FIG. 8 is a left side view of a golfer using the swing training apparatus showing the golfer initiating the forward swing.
Figure 9:
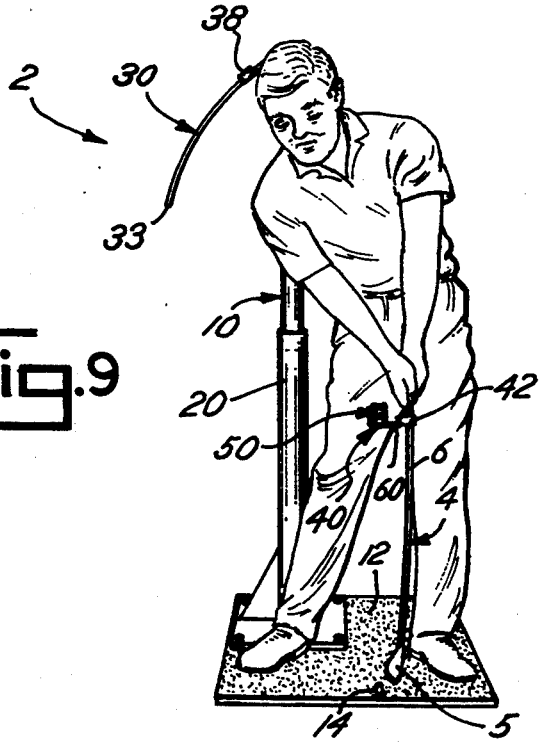
FIG. 9 is a golfer using the swing training apparatus at the contact point of the golf swing.

FIGS. 6 and 8, show the golfer beginning the forward swing. The golfer first shifts weight from the right to the left side. This weight shift from the right to the left side initiates the forward swing and the movement of club attachment 40 downward along track 30. As shown in FIGS. 6 and 8, as club attachment 40 moves downward along track 30, club attachment 40 maintains the proper attitude of club 4 within a swing plane parallel to the plane of track 30. While club attachment 40 is engaged with track 30, the golfer is forced by his grip of club 4 to hold the club with his wrists cocked and execute the golf swing using the proper technique.

FIG. 7 shows the golfer at the release point of the forward swing at the start of the "attack zone." At the release point, carriage 50 clears lower end 33 of track 30. Once carriage 50 clears track 30, the golfer's wrist are free to break. The downward momentum of the swing naturally carries the golfer through the contact point (FIG. 9) on the correct swing plane while his wrists and shoulders extend to develop maximum club head speed. It should be noted that the movement of the golfer is restricted only for a relatively short portion of the entire swing; however, the golfer's movement is guided and controlled through the critical initial portion of the forward swing into the "attack zone."

It is understood that the above description does not limit the invention to the details given, but may be modified within the scope of the following claims.

I claim:

1. An apparatus used with a golf club by a golfer for developing a forward golf swing, said apparatus comprising:

an arcuate track segment having two longitudinal ends adapted to be positioned behind said golfer when executing said forward swing for guiding said club within a predetermined swing plane through an initial portion of said forward swing, and attachment means connectable to said club and movable along the length of said track for maintaining said club at a fixed predetermined attitude within said swing plane while said attachment means is in engagement with said track.

2. The apparatus of claim 1 wherein said attachment means includes a carriage for guided movement along the length of said track, said carriage passes longitudinally from one end of said track during said forward swing.

3. The apparatus of claim 2 wherein said carriage includes a pair of parallel rollers axially spaced from each other to define said passage therebetween for receiving said track, said track is interposed between said rollers for unilateral movement along the length of said track when said carriage is in engagement with said track.

4. The apparatus of claim 2 and a stop part connected to said track for positioning said carriage along said track at the starting point of said forward swing, said carriage abuts said stop part when said carriage is in engagement with said track at the starting point of said forward swing.

5. The apparatus of claim 1 and a post positioned behind said golfer when executing said forward swing, said track is pivotally connected to said post for adjusting the position of said track relative to said golfer.

6. The apparatus of claim 4 wherein said track includes an arm part extending from said track, said arm part is pivotally connected to said post.

7. The apparatus of claim 5 wherein said post includes a first part and a second part extensibly connected to said first part for adjusting the length of said post to position said track relative to said golfer.

8. The apparatus of claim 5 and a platform for supporting said golfer when executing said forward swing, said post mounted to said platform.

9. In combination, a golf club including a shaft and grip mounted to one end of said club shaft, and an apparatus used by a golfer for developing the forward golf swing, said apparatus comprising:

an arcuate track segment having a length between two longitudinal ends spaced apart a distance sufficient to guide said club within a predetermined swing plane only through an initial portion of said forward swing, and attachment means connected to said club shaft adjacent said grip and movable along said length of said track for maintaining said club at a fixed predetermined attitude within said swing plane while said attachment means is in engagement with said track.

10. The combination of claim 9 wherein said attachment means includes a carriage for guided movement along the length of said track, said carriage being connected to said club shaft adjacent said grip part.

11. The combination of claim 10 wherein said carriage passes longitudinally from one end of said track during said forward swing.

12. The combination of claim 10 wherein said carriage includes a pair of parallel rollers axially spaced from each other to define said passage therebetween for receiving said track, said track is interposed between said rollers for unilateral movement along said length of said track when said carriage is in engagement with said track.

13. The combination of claim 10 wherein said attachment means also includes a collar connected to said club shaft adjacent said grip, and a rod part connecting said collar to said carriage whereby said club is spaced from said carriage.

14. The combination of claim 13 wherein said club also includes a head connected to the other end of said club shaft, said rod part has two ends, one rod end is secured to said carriage, the other rod end is secured to said collar for permitting adjustment of the position of the face of said club head within said swing plane.

15. The apparatus of claim 10 and a stop part connected to said track for positioning said carriage along said track at the starting point of said forward swing, said carriage abuts said stop part when said carriage is in engagement with said track at the starting point of said forward swing.

16. The combination of claim 9 wherein said track is positioned behind said golfer when executing said forward swing.

17. The combination of claim 16 and a post positioned behind said golfer when executing said forward swing, said track is pivotally connected to said post for adjusting the position of said track relative to said golfer.

18. The apparatus of claim 17 wherein said track includes an arm part extending from said track, said arm part being pivotally connected to said post.

19. The apparatus of claim 18 wherein said post includes a first part and a second part extensibly connected to said first part for adjusting the length of said post to position said track relative to said golfer.

20. In combination, a golf club including a shaft and a grip mounted to one end of said club shaft, and an apparatus used by a golfer for developing the forward golf swing, said apparatus comprising:

a platform, a post extending upward from said platform, a track segment having two longitudinal ends supported by said post and adapted to be positioned behind said golfer for guiding said club through a portion of said golf swing within a predetermined swing plane, a carriage for guided longitudinal movement along the length of said track, a collar connected to said club shaft adjacent said grip, and a rod part connecting said collar to said carriage for maintaining the attitude of said club within said swing plane while said carriage is in engagement with said track.

* * * * *